US007633003B2

(12) United States Patent
Usa et al.

(10) Patent No.: US 7,633,003 B2
(45) Date of Patent: Dec. 15, 2009

(54) PERFORMANCE CONTROL APPARATUS AND PROGRAM THEREFOR

(75) Inventors: Satoshi Usa, Hamamatsu (JP); Tomomitsu Urai, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/689,526

(22) Filed: Mar. 22, 2007

(65) Prior Publication Data

US 2007/0234882 A1 Oct. 11, 2007

(30) Foreign Application Priority Data

Mar. 23, 2006 (JP) ..... 2006-080951

(51) Int. Cl.
*A63H 5/00* (2006.01)

(52) U.S. Cl. ..... 84/609; 84/612; 84/636; 84/649; 84/652; 84/668

(58) Field of Classification Search ..... 84/609, 84/612, 636, 649, 652, 668, 602
See application file for complete search history.

(56) References Cited

U.S. PATENT DOCUMENTS

| | | | | |
|---|---|---|---|---|
| 4,694,723 | A * | 9/1987 | Shinohara et al. | 84/609 |
| 5,056,401 | A * | 10/1991 | Yamaguchi et al. | 84/635 |
| 5,521,324 | A * | 5/1996 | Dannenberg et al. | 84/612 |
| 6,180,865 | B1 * | 1/2001 | Ishiguro | 84/609 |
| 6,372,975 | B1 * | 4/2002 | Shinsky | 84/612 |
| 6,696,631 | B2 * | 2/2004 | Smith et al. | 84/645 |
| 2004/0011189 | A1 * | 1/2004 | Ishida et al. | 84/626 |
| 2005/0016362 | A1 * | 1/2005 | Nishitani et al. | 84/612 |
| 2006/0054006 | A1 * | 3/2006 | Akazawa | 84/609 |
| 2006/0152678 | A1 * | 7/2006 | Hung et al. | 352/12 |
| 2007/0157798 | A1 * | 7/2007 | Sako et al. | 84/611 |

FOREIGN PATENT DOCUMENTS

| | | |
|---|---|---|
| JP | 04-133097 | 5/1992 |
| JP | 2530744 | 12/1996 |
| JP | 2543307 | 4/1997 |
| JP | 10-198358 | 7/1998 |
| JP | 2000-276141 | 10/2000 |
| JP | 2002-244662 | 8/2002 |
| JP | 2003-091280 | 3/2003 |
| JP | 2004-101957 | 4/2004 |
| JP | 2005-241747 | 9/2005 |

* cited by examiner

*Primary Examiner*—Walter Benson
*Assistant Examiner*—Kawing Chan
(74) *Attorney, Agent, or Firm*—Harness, Dickey & Pierce, PLC

(57) ABSTRACT

A performance control apparatus that prevents erroneous key depressions from disturbing musical performance and allow an inexperience player to play at ease. A performance operator is adapted to generate performance operation information in response to performance operations by a user, the performance operation information including information indicative of performing timing in automatic performance. A storage device is adapted to store data of a music piece comprising sequence data of note information for individual musical tones. A performance control device is adapted to, each time the performance operation information is generated, calculate tempo of automatic performance on the basis of the difference in generation time between the present performance operation information and the previous performance operation information, and to read out the data of the music piece from the storage device with the tempo; wherein the performance control device is adapted to exclude currently the present performance operation information from calculation of the tempo if the difference in generation time is less than a predetermined threshold.

8 Claims, 7 Drawing Sheets

KEY DEPRESSION: SOUND GENERATION INSTRUCTION DATA (TEMPO) IS DETERMINED ON THE BASIS OF THE PAST TIME DIFFERENCES.

ERRONEOUS KEY DEPRESSION: IGNORED IF TIME DIFFERENCE IS LESS THAN THE THRESHOLD

PERFORMANCE CONTROL APPARATUS AND PROGRAM THEREFOR

BACKGROUND OF THE INVENTION

1. Field of the Invention

The present invention relates to a performance control apparatus that sequences data of a music piece for a predetermined duration according to operation by a player, as well as a program for the performance control apparatus.

2. Description of the Related Art

Conventionally, there have been known electronic musical instruments that generate musical tones in response to operation by a player. Such electronic musical instruments are modeled on, for example, pianos and generally carry out performance operations in a manner similar to pianos that are acoustic musical instruments. These electronic musical instruments require skill to perform and much time to learn.

An electronic musical instrument (electronic piano) detects the keying velocity of a player and generates musical tones in accordance with the keying velocity. The electronic piano is equipped with sensors, one for each key, for detecting the keying velocity. The sensors measure the on/off time of multiple contacts, or use elastically deforming members for contacts and utilize the behavior of the members to detect the keying velocity. However, the use of contacts in the sensors causes chattering (repetitive on and off behavior). To prevent the chattering, an apparatus according to Prior Art 1 has been proposed that ignores on/off switching that occurs in a short period of time (see for example Japanese Patent Laid-Open No. 2002-244662).

On the other hand, electronic musical instruments are used by a wide variety of users at all levels from beginners to skilled players. Skilled players want electronic musical instruments capable of providing a wide range of nuance in accordance with performance operations like acoustic musical instruments. In contrast, beginners want electronic musical instruments that allow them to play by simple operations.

In order to meet these demands, an apparatus according to Prior Art 2 has been proposed that automatically plays musical tones for a given time period (for example ½ bar) when a player performs a simple operation (swing by hand) (see, for example, Japanese Patent Laid-Open No. 2000-276141). Japanese Patent Laid-Open No. 2000-276141 describes a musical instrument consisting of multiple slave units and a single master unit. Such an electronic musical instrument generates musical tones in accordance with a player's performance operation. That is, when a player performs a performance operation using a performance operator, information such as the velocity of the performance operation by the player is sent from a slave unit to the master unit, where musical tone data for the musical part assigned to the slave unit is read and a timbre and other characteristics of the musical tone are determined on the basis of the velocity of the player's performance operation.

There has been proposed an apparatus according to Prior Art 3 that sets an upper limit on the velocity of performance operations and, if an operation is performed at a velocity exceeding the predetermined threshold, the operation is assumed to be treated at the upper limit velocity (see, for example, Japanese Patent No. 3720004). The threshold can be varied to change the level of response to performance operations. Thus, the level of difficulty of controlling musical characteristics (stability or musical expression ability) can be adjusted according to player's proficiency level.

As stated above, there has been demand for musical instruments that can be played even by inexperienced players with ease in recent years. It is conceivable that slave units of an electronic musical instrument such as the apparatus according to Prior Art 2 are used as electronic pianos.

However, a beginner can perform wrong operations (accidentally hit neighboring keys at approximately the same time) on an electronic piano that is a slave unit. The apparatus according to Prior Art 1 prevents key chattering but not erroneous performance operations. Furthermore, the keyboard of the apparatus has a complex contact structure and therefore a complex algorithm.

An electronic musical instrument such as the apparatus according to Prior Art 3 treats performance operations performed at a velocity exceeding a predetermined threshold as operations performed at an upper limit velocity to reduce variations in tempo. However, the apparatus does not prevent erroneous performance operations. If keys are depressed at approximately the same time, the tempo of performance significantly changes, causing irregularities in performance.

SUMMARY OF THE INVENTION

The present invention provides a performance control apparatus and a program therefor that prevent erroneous key depressions from disturbing musical performance and allow an inexperience player to play at ease.

In a first aspect of the present invention, there is provided a performance control apparatus comprising: a performance operator adapted to generate performance operation information in response to performance operations by a user, the performance operation information including information indicative of performing timing in automatic performance; a storage device adapted to store data of a music piece comprising sequence data of note information for individual musical tones; and a performance control device adapted to, each time the performance operation information is generated, calculate tempo of automatic performance on the basis of the difference in generation time between the present performance operation information and the previous performance operation information, and to read out the data of the music piece from the storage device with the tempo; wherein the performance control device is adapted to exclude currently the present performance operation information from calculation of the tempo if the difference in generation time is less than a predetermined threshold.

According to the present invention, the difference in generation time between musical performance operations is detected and, if the difference in generation time is less than a threshold, it is determined that the operations are successive key depressions performed accidentally and the performance operations are ignored and determination of characteristics such as tempo of the music tones is omitted. Thus, erroneous operations do not cause irregularities in musical performance and therefore an inexperienced player can enjoy playing at ease.

According to the present invention, when a player uses a performance operator to play a performance operation (for example, a key depression), an operation signal including information indicating timing of performance is generated. The performance timing is indicated at regular intervals such as every single beat, two beats, or ½ beat by a direction by a facilitator, for example, who guides the performance. The performance control apparatus determines parameters such as the volume and quality of a musical tone on the basis of the operation signal and musical piece data (for example, MIDI data). When an operation signal is generated by a performance operation, the difference in generation time between the present operation signal and the generation of the previous operation signal is calculated. If the calculated time difference is greater than or equal to a predetermined threshold, tempo of the musical tones and the volume and intensity of each tone are determined on the basis of the time difference. If the calculated difference in generation time is less than the threshold, it is determined that successive key depressions have been accidentally performed and determination of characteristics such as sound volume and intensity is omitted.

The performance control device can be adapted to update the threshold on the basis of the difference in generation time.

According to the present invention, the threshold is updated, even during performance, on the basis of the difference in generation time after the time when the previous operation signal has been generated.

The performance control device can be adapted to count the present performance operation information as performance operation information generated by an erroneous operation if the difference in generation time is less than the threshold and to record information including the number of pieces of performance operation information generated by erroneous operations in the storage device.

According to the present invention, the number of erroneous operations identified by differences in generation time less than thresholds is counted and recorded as a log. A facilitator can check the log to see the number of erroneous operations and thereby know the level of proficiency of each player, for example. In addition to the number of erroneous operations, other information such as the times at which the erroneous operations occurred, the keys depressed (note numbers), key depression velocities, and the title of the music piece played may be recorded.

The performance control device can be adapted to determine the threshold or the basis of information including the number of pieces of performance operation information generated by erroneous operations recorded in the storage device.

According to the present invention, specifically the threshold is determined on the basis of the number of erroneous operations recorded as a log. For example, if many erroneous operations occurred, a larger threshold is set to prevent change of tempo due erroneous operations, thereby preventing irregularities in performance.

The performance operator has a plurality of keys adapted to generate performance operation information in response to performance operations by a user, the performance operation information having different note numbers for different keys, and the performance control device can be adapted to exclude the present performance operation information from calculation of the tempo if the difference in generation time is less than a predetermined threshold and the key corresponding to the present performance operation information and the key corresponding to the previous performance operation information are adjacent to each other.

According to the present invention, the operation element has multiple keys. When a player depresses one of the keys, a note number associated with the key is included in the operation signal generated. When an operation signal is generated by a performance operation, the difference in generation time between the present operation signal and the previous operation signal is calculated. If the calculated difference in generation time is greater than or equal to a predetermined threshold, the tempo of musical tones is determined on the basis of the difference in generation time and other parameters such as the volume and quality of the musical tones are determined on the basis of the difference in generation time. If the difference in generation time is less than the threshold, the key corresponding to the current operation signal is compared with the key corresponding to the previous operation signal. If they are not adjacent to each other, the key depressions are not considered as an erroneous operation and tempo of the musical tones and parameters such as the volume and intensity of each musical tone are determined on the basis of the difference in generation time. Since a key adjacent to an intended key is likely to be accidentally depressed, determination as to whether a key depression is erroneous can be restricted to keys adjacent to the previously depressed key.

The performance operator can be adapted to, in every performance operation by a user, generate a note-on message for the performance operation information at the start of the performance operation and generate a note-off message for the performance operation information at the end of the performance operation, and the musical performance control device can be adapted to exclude the present performance operation information from calculation of the tempo if the difference in generation time is less than a predetermined threshold and no note-off message is generated for the previous performance operation information According to the present invention, when a player depresses a key, a note-on message is generated; when the player releases that key, a note-off message is generated. When an operation signal is generated in response to a performance operation, the difference in generation time generation between the present operation signal and the previous signal is calculated. If the calculated time difference is greater than or equal to a predetermined threshold, tempo of the musical tones and parameters such as the volume and quality of each musical tone is determined on the basis of the difference in generation time. If the difference in generation time is less than the threshold, determination is made as to whether a note-off message for the previous performance operation has been generated. If the note-off message has not been generated, it is determined that the operations are successive erroneous key depressions and determination of the parameters such as the volume and quality of the musical tones is omitted. A key adjacent to an intended key is likely to be accidentally depressed at approximately the same time as the intended key is depressed. Therefore, determination as to whether or not a key depression is an erroneous operation can be restricted a case where a note-off message of the previous key depression has not been received.

In a second aspect of the present invention, there is provided a program for causing a musical performance control apparatus, comprising a performance operator adapted to generate performance operation information in response to performance operations by a user, the performance operation information including information indicative of performing timing in automatic performance, and a storage device adapted to store data of a music piece comprising sequence data of note information for individual musical tones, to execute: a performance control module of, each time the performance operation information is generated, calculate tempo of automatic performance on the basis of the difference in generation time between the present performance operation information and the previous performance operation information, and reading out the data of the music piece data from the storage device with the tempo, wherein the performance control module comprising excluding the present performance operation information from calculation of the tempo if the difference in generation time is less than a predetermined threshold.

The above and other objects, features, and advantages of the invention will become more apparent from the following detailed description taken in conjunction with the accompanying drawings.

BRIEF DESCRIPTION OF THE DRAWINGS

FIG. 6A shows an example in which information indicating a pitch (note number) sent from a performance terminal 2 is used to detect an erroneous operation and FIG. 6B shows an example in which a note-off message sent from a performance terminal 2 is used to detect an erroneous operation.

DETAILED DESCRIPTION OF THE PREFERRED EMBODIMENTS

Embodiments of the present invention will be described with reference to the accompanying drawings.

Figure 1:
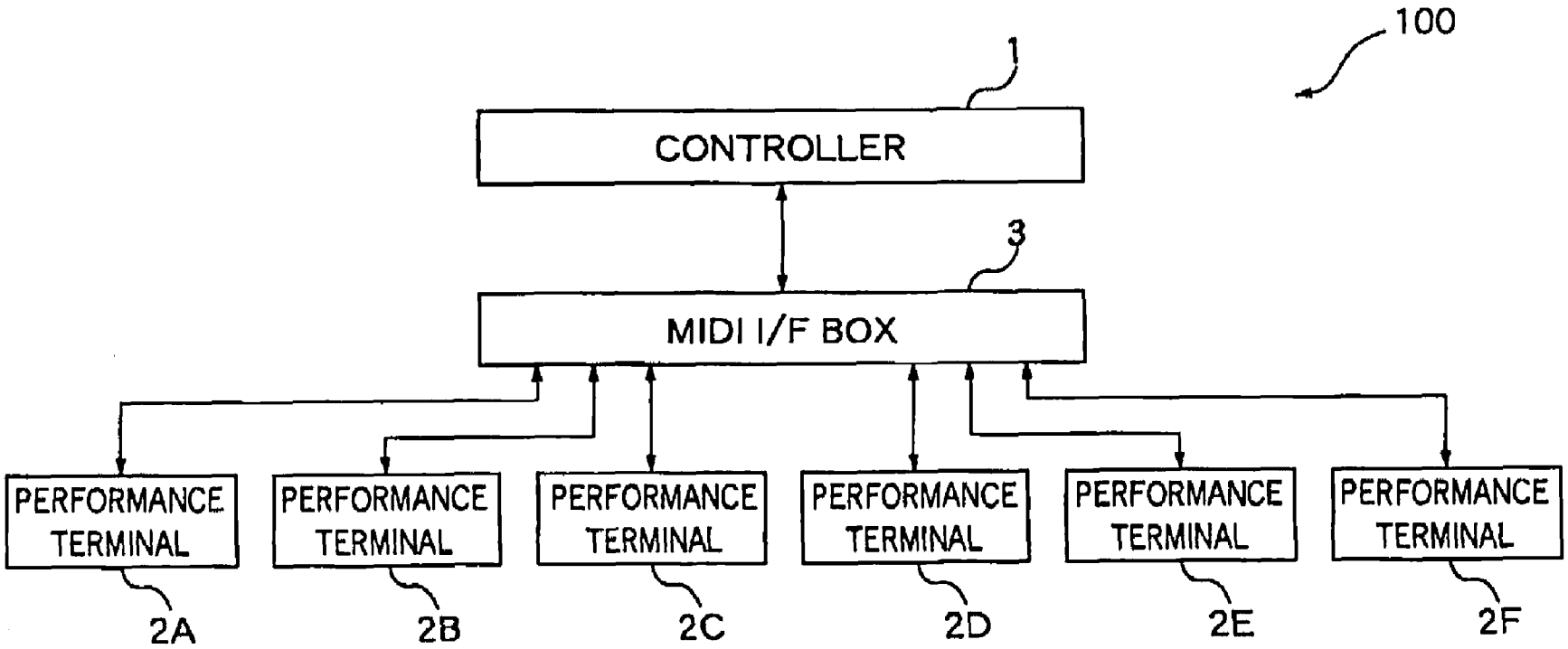
FIG. 1 is a block diagram showing the construction of an ensemble system including a controller as a musical performance control apparatus according to an embodiment of the present invention.

FIG. 1 is a block diagram showing an ensemble system including a controller 1 which is a performance control apparatus according to an embodiment of the present invention. The ensemble system 100 includes a controller 1 and a plurality of (six in FIG. 1) performance terminals (2A-2F) connected to the controller 1 through a MIDI interface box 3. In this embodiment, the interposition of the MIDI interface box 3 allows the performance terminals 2 to be connected to the controller 1 through separate MIDI channels. The MIDI interface box 3 is connected to the controller 1 through a USB.

In the ensemble system 100 according to the embodiment, the controller 1 controls the performance terminals 2 so as to automatically play different musical parts, thereby playing in ensemble. A musical part is a tune, for example, constituting an ensemble. Examples of musical parts include one or more melody parts, rhythm parts, and multiple accompanying parts played by different instruments.

In the ensemble system 100, each of the performance terminals 2 does not perform full automatic performance but a player of each of the performance terminals 2 indicates a sound volume, intensity, timing, and tempo by performance operation for each piece of data for each of the musical parts in a predetermine length of time (for example, sectional data such as ½ bar). The ensemble system 100 performs an ensemble at appropriate playing timing when each player performs a performance operation at particular operation timing.

The operation timing may be common to the performance terminals 2 or may be indicated by a performance operation performed by a facilitator (for example, the player of performance terminal 2A) acting as a guide, or may be indicated by a direction using a hand by the facilitator to the players. If the players play in accordance with the operation timing indicated, appropriate ensemble is performed.

Each of the performance terminals 2 is implemented by an electronic keyboard instrument such as an electronic piano. The performance terminal 2 accepts a performance operation (for example a depression of one of the keys on the keyboard). The performance terminals 2 have the capability of communicating with the controller 1 and send an operation signal indicating operation information (for example, a note-on message in MIDI data) to the controller 1. The operation information includes information indicating a pitch. The controller 1 in the present embodiment uses operation information as information indicating timing of a performance operation by ignoring (filtering out) information indicating a pitch. Therefore, depression of any key with the same force causes the same operation signal to the controller 1. Thus, a player unfamiliar with playing keyboard instruments can play simply by pressing any one of the keys.

The controller 1 may be implemented by a personal computer, for example, and software installed in the personal computer controls musical performance on the performance terminals 2. In particular, musical data consisting of multiple musical parts is stored in the controller 1. The controller 1 allocates a musical part (or parts) to each of the performance terminals 2 before starting an ensemble.

The controller 1 has the capability of communicating with the performance terminals 2. When the controller 1 receives an operation signal indicating a performance operation from a performance terminal 2, the controller 1 determines, on the basis of the operation signal, tempo and timing of the musical part allocated to the performance terminal 2 that output the operation signal. The controller 1 then sequences a predetermined time length of musical piece data for the allocated musical parts with the determined tempo and timing and sends the data to the performance terminals 2 as sound generation instruction data. The sound generation instruction data includes timing of sound generation, the length of sound, sound volume, timbre, effects, pitch variations, (pitch bends), and tempo.

The performance terminals 2 plays automatic performance of different musical parts in accordance with sound generation instruction data by using a built-in sound generator. Thus, the performance terminals 2 play the musical parts allocated by the controller 1 with the intensity indicated by the players through performance operations and, as a result, an ensemble is performed. The performance terminals 2 are not limited to electronic pianos. The performance terminals 2 may be other electronic instruments such as electronic guitars. Of course, the appearance of the performance terminal is not limited to a natural musical instrument. It may be a terminal equipped with simple operating elements such as buttons.

Each of the performance terminals 2 does not need to have a built-in sound generator. A separate sound generator may be connected to the controller 1. In this case, a single sound generator or as many sound generators as the number of the performance terminals 2 may be connected to the controller 1. If as many sound generators as the number of the performance terminals 2 are connected, the controller 1 may associate the sound generators with the performance terminals 2 and allocate musical parts of musical piece data to them.

Constructions of the controller 1 and the performance terminal 2 will be described below in detail.

Figure 2:
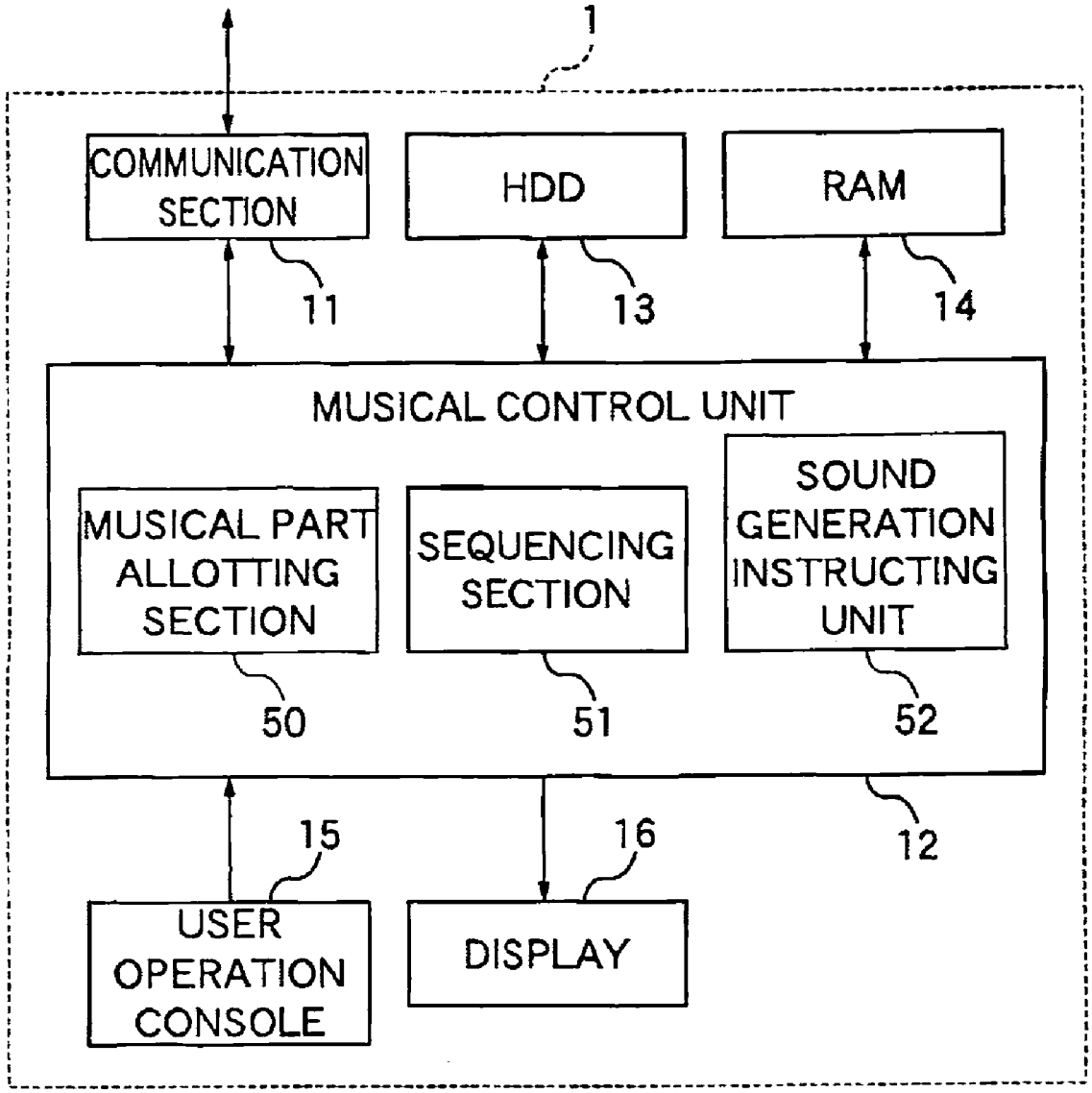
FIG. 2 is a block diagram showing the construction of the controller shown in FIG. 1.

FIG. 2 is a block diagram showing the construction of the controller 1 shown in FIG. 1. As shown, the controller 1 includes a communication section 11, a control section 12, a hard disk drive 13, a RAM 14, a user operation console 15, and a display 16. Connected to the control section 12 are the communication sections 11, the hard disk drive 13, the RAM 14, the user operation console 15, and the display 16.

The communication section 11 communicates with performance terminals 2 and has a USB interface. Connected to the USB interface is a MIDI interface box 3. The communication section 11 communicates with the six performance terminals 2 through the MIDI interface box 3 and MIDI cables. The HDD 13 stores operating programs with which the controller 1 operates and musical piece data consisting of multiple musical parts.

The control section 12 reads an operating program stored in the HDD 13 and loads it in the RAM 14, which is a work memory, and executes processing of musical part allocating section 50, a sequencing section 51, and a sound generation instructing section 52. The musical part allocating section 50 allocates musical parts of musical piece data to performance terminals 2. The sequencing section 51 determines tempo and timing based on operation signals received from the performance terminals 2 and sequences (determines parameters such as the sound volume and timbre of) each musical part of the musical piece data using the determined tempo and timing. The sound generation instructing section 52 sends parameters such as the volume of sound and timbre determined at the sequencing section 51 to the performance terminals 2 as sound generation instruction data.

The user operation console 15 is used by a player (mainly a facilitator) for issuing instructions to the ensemble system 100 to operate. The facilitator operates the user operation console 15 to specify musical piece data to play and allocate musical parts to the performance terminals 2. The display 16 is a monitor. The facilitator and players look at the display 16 while playing. The display 16 displays information such as performance timing for playing in ensemble.

The control section 12 determines the tempo for sound generation instruction data on the basis of the difference in time between a performance operation and the next performance operation. That is, the control section 12 determines the tempo on the basis of the input time difference between note-on messages in operation signals it has received from the performance terminals 2.

It should be noted that the moving averages of multiple performance operations (the last several performance operations) may be calculated and a time-weight may be assigned to them. The heaviest weigh is assigned to the last performance operation and increasingly lighter weights are assigned to older performance operations. By determining tempo in this way, the tempo can be naturally changed in accordance with the flow of a music piece without a sudden change of tempo even if there is a significant irregular change in the time intervals between performance operations.

Figure 3:
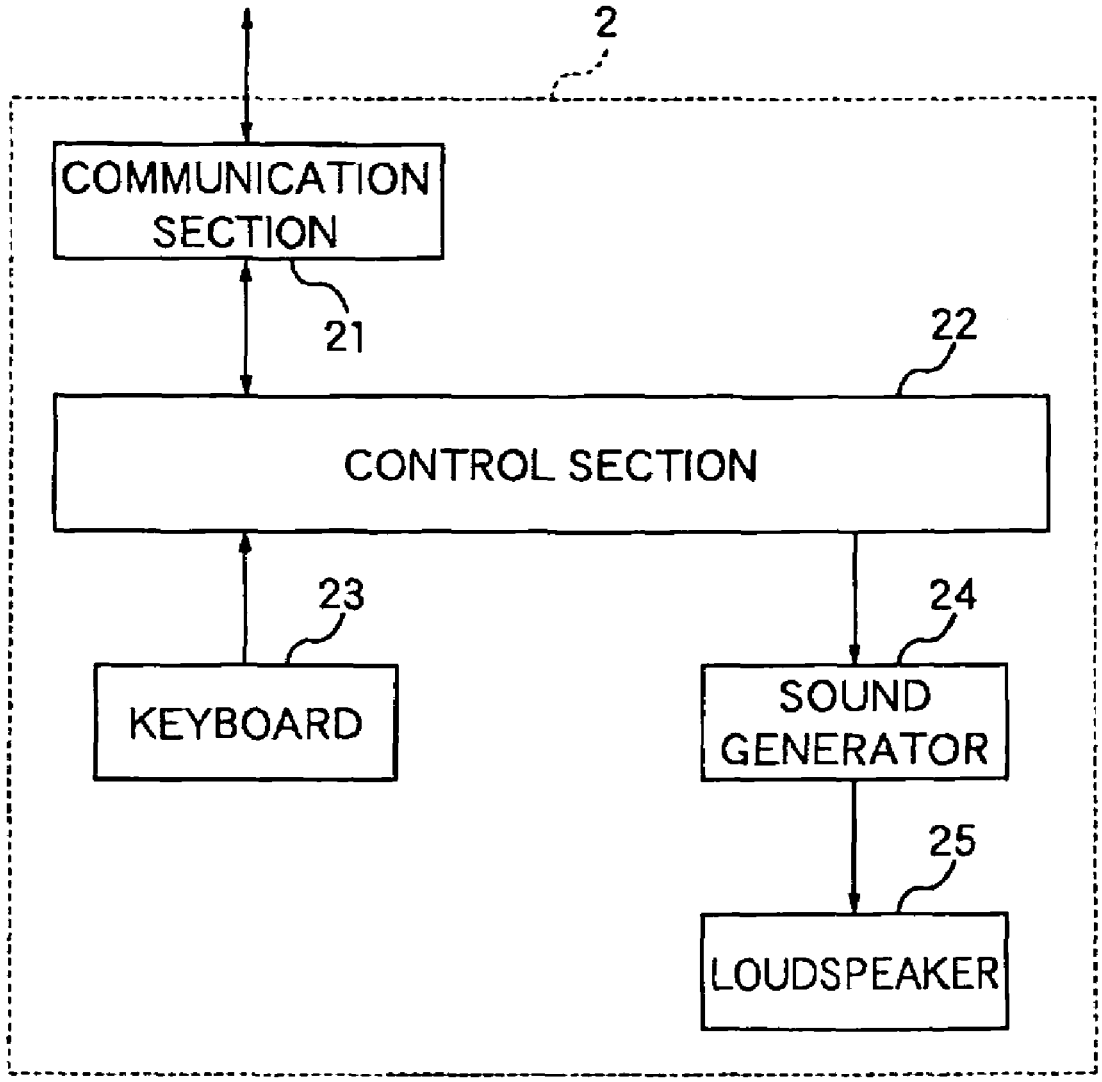
FIG. 3 is a block diagram showing the construction of a performance terminal shown in FIG. 1.

FIG. 3 is a block diagram showing the construction of the performance terminal 2 shown in FIG. 1. As shown, the performance terminal 2 includes a communication section 21, a control section 22, a keyboard 23, which is a performance operator, a sound generator 24, and a loudspeaker 25. The communication section 21, the keyboard 23, and the sound generator 24 are connected to the control section 22. The loudspeaker 25 is connected to the sound generator 24.

The communication section 21 is a MIDI interface which communicates with the controller 1 through a MIDI cable. The control section centrally controls the performance terminal 2.

The keyboard 23 has 61 or 88 keys, for example, and is capable of playing 5 to 7 octaves. In the ensemble system 100, however, the keys are not differentiated but instead note-on/note-off messages and data indicating how hard the keys are depressed (key depression velocity) are used. In particular, each key has a built-in sensor that senses the on/off operations and a built-in sensor that senses key depression intensity. The keyboard 23 provides an operation signal responsive to the fashion in which keys are operated (such as which key has been pressed and how hard) to the control section 22. The control section 22 sends note-on and note-off messages to the controller 1 through the communication section 21 on the basis of an operation signal input to it.

The sound generator 24 generates a musical sound waveform in accordance with the control (namely the sound generation instruction data) of the control section 22 and outputs it as a sound signal to the loudspeaker 25. The loudspeaker 25 reproduces the sound signal input from the sound generator 24 and outputs musical tones. While the sound generator 24 and the loudspeaker 25 are contained in each of the performance terminals 2 in this embodiment, the present invention is not so limited. For example, a sound generator and a loudspeaker may be connected to the controller 1 so that musical tones are output from a location different from the locations of the performance terminals 2. In this case, as many external sound generators as the number of the performance terminals 2 or a single sound generator may be connected to the controller 1.

In the present embodiment, the control section 22 sends a note-on/note-off message to the controller 1 when a key of the keyboard 23 is depressed and a musical tone is generated in response to an instruction from the controller 1 (local off) instead of the note message from the keyboard 23. However, the performance terminal 2 can also be used as a conventional electronic musical instrument, of course, in addition to functioning as described above. When a key of the keyboard 23 is depressed, the control section 22 can instruct the sound generator 24 to generate a musical tone in accordance with that note message (local on). Switching between the local on and local off may be made by a user through use of the user operation console 15 of the controller 1 or a terminal operation console (not shown) on the performance terminal 2. Furthermore, some of the keys may be set to local-off mode and the others to local-on mode.

The control section 12 of a conventional controller 1 has determined tempo on the basis of the time difference between note-on message receptions. However, beginners intending to depress one of the keys of a keyboard 23 have often accidentally depressed an adjacent key as well. In such a case, more than one note-on message is transmitted in a short time, considerably changing the tempo. According to the present embodiment, a threshold for the time difference between note-on message receptions is set and continuous key depressions performed in a time less than the threshold are ignored to prevent fluctuations in tempo due to erroneous performance operations. Thus, inexperienced player can enjoy playing at ease.

Figure 4:
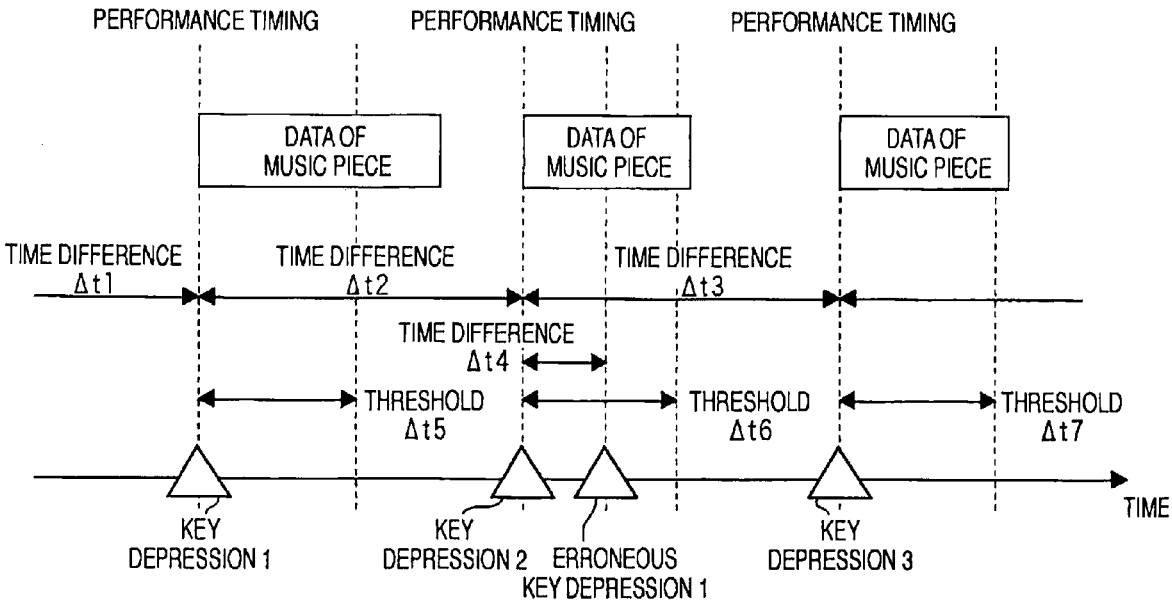
FIG. 4 is a diagram showing the relationship among musical piece data, a player's key depression velocity, and a specified sound volume value used when sound generation instructing data is determined by the controller.

Operation for determining sound generation instruction data according to the present embodiment will be described below. FIG. 4 is a diagram showing the relationship among musical piece data, key depressions by a player, and the time differences between note-on message receptions when sound generation instruction data is determined by the controller 1. The horizontal axis in FIG. 4 represents the flow of time. When the player depresses a key of the keyboard 23 of a performance terminal 2, a note-on message is sent to the controller 1, sound generation instruction data for a predetermined length (for example, 1 beat) is determined, and a musical tone is generated.

The control section 12 receives the note-on message and calculates the time difference $\Delta t2$ between the reception of the previous note-on message (the timing of key depression 1) and the reception of the current note-on message (at key depression 2). The time difference Δt2 is compared with a predetermined threshold Δt5 (which will be described later). If the time difference Δt2 between the key depressions is greater than or equal to the predetermined threshold Δ5*t*, the current key depression is considered as a correct performance operation and timing and tempo are determined. The tempo may be determined on the basis of the time difference Δt2 or may be average value of the previous time difference Δt1 and the current time difference Δt2. Alternatively, it may be determined on the basis of the average of the past time differences. As described above, the heaviest weight may be assigned to the latest time difference and increasingly lighter weights may be assigned to time differences between older performance operations.

Then, musical piece data for 1 beat is read with the determined timing and tempo and sound generation instruction data is determined. The determined sound generation instruction data is sent to the performance terminal 2. The control section 12 updates the threshold on the basis of the time difference Δt2. The updated threshold Δt6 will be used when the next note-on message is input. For example, Δt6=Δt2/2. That is, the threshold Δt5 compared with the time difference Δt2 at key depression 2 is represented as Δt5=Δt1/2, which has been updated when key depression 1 is performed. The method for updating the threshold is not limited to the example that is based on the latest key depression time difference. The threshold may be determined on the basis of the average value of the past key depression time differences. Furthermore, a fixed threshold may be used for performance of a music piece. The fixed value may be allowed to be manually changed by a facilitator.

When a note-on message is input in response to an erroneous key depression 1 (erroneous key depression made when key depression 2 was performed) in FIG. 4, the time difference Δt4 between the reception of the previous note-on message (the timing of key depression 2) and the reception of the current note-on message (at key depression 1) is calculated. The time difference Δt4 is compared with threshold Δt6. If the time difference Δt4 is less than the threshold Δt6, the current key depression is considered as an erroneous operation and the current note-on message is ignored. Therefore, for this note-on message, determination of tempo and timing is omitted and sound generation instruction data is not determined. Of course, the threshold is not updated.

When a note-on message is input in response to the next key depression 3, the time difference Δt3 between key depressions 2 and 3 is calculated. The time difference Δt3 is compared with the threshold Δt6. If the time difference Δt3 is greater than or equal to the threshold Δt6, the current key depression is considered as a correct performance operation and timing and tempo are determined. Consequently, sound generation instruction data is determined from the key depression 3. The threshold is updated based on the time difference Δt3. The threshold Δt7 to be used when the next note-on message is input is updated as Δ7=Δt3/2.

Figure 5:
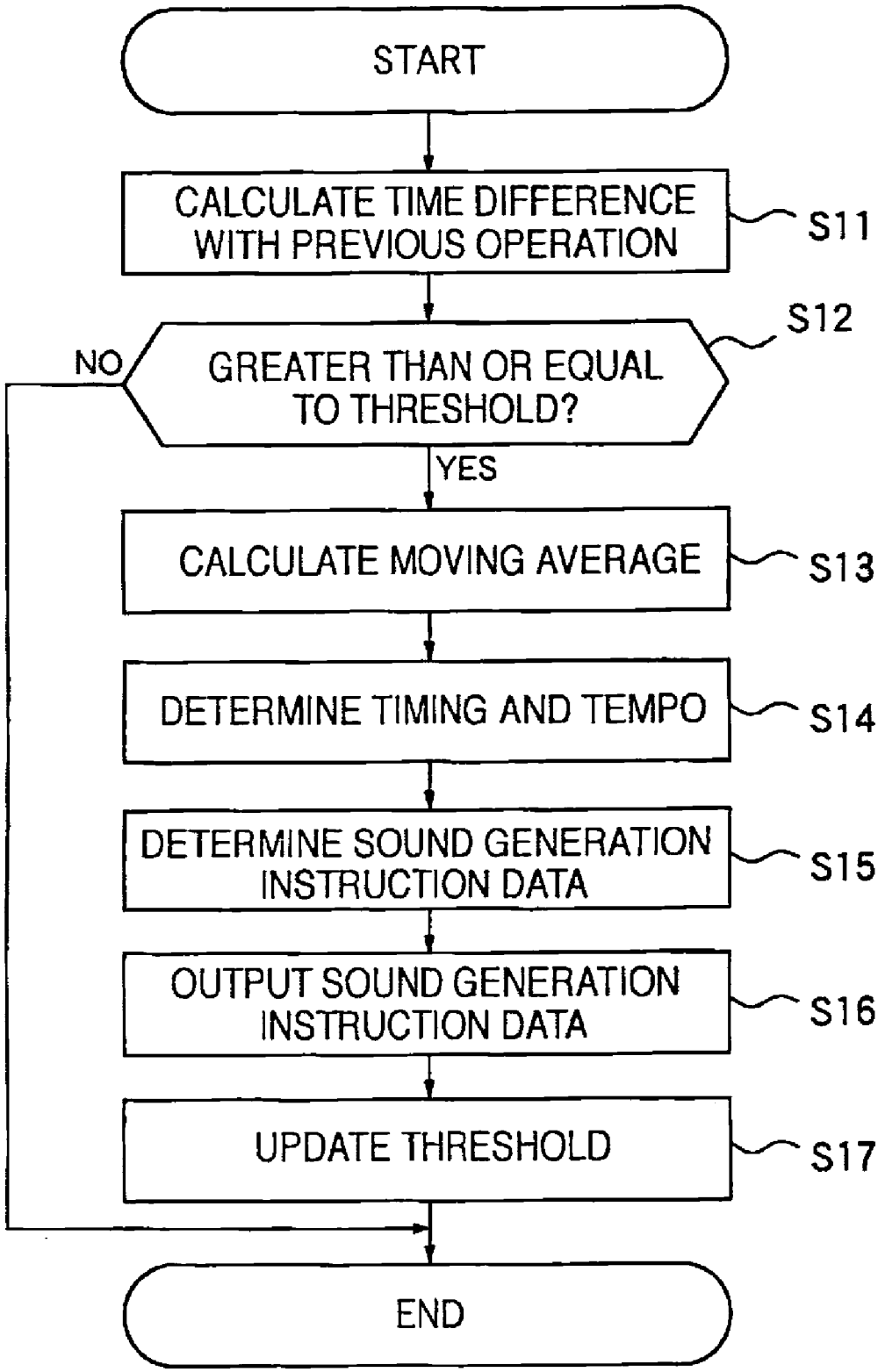
FIG. 5 is a flowchart of a procedure for determining sound generation instructing data performed by the controller.

The operation performed by the control section 12 for determining sound generation instruction data will be described with reference to a flowchart. FIG. 5 is a flowchart illustrating a procedure performed by the controller 1 for determining sound generation instruction data. This operation is triggered by input of a note-on message from a performance terminal 2. First, the time difference between the input of this note-on message and the input of the previous note-on message is calculated (step S11). It should be noted that when the first note-on message is input at the beginning of performance, normally there is no previous note-on message input. In the present embodiment, the time difference from a previous note-on message when the first note-on message is input at the beginning of performance is determined as follows.

When players depresses keys in response to a cue by a facilitator after allocation of musical parts to the performance terminals 2 for playing in ensemble, musical piece data is not read, musical tones are not generated (or only rhythm sound "tum-tum" is generated), and only note-on messages for determining tempo are input for the first several performance timings (for example, four key depressions). In this case, determination of sound generation instruction data is omitted (or determination is made that rhythm sound is to be generated) at the step of determining sound generation instruction data (step S15), which will be described later. It is not until the fifth performance timings that musical piece data is read, sound generation instruction data is determined, and performance is started. It should be noted that time difference calculation at step S11 is not performed for the first one of the note-on messages used for determining the tempo because there is no previous performance timing.

Then, the control section 12 determines whether the time difference calculated at step S11 is greater than or equal to a predetermined threshold (step S12). The threshold may be a value updated at the previous performance timing (processing at step S17, which will be described later) or may be a fixed value for performance of one music piece. If the time difference is greater than or equal to the threshold, the current key depression is considered as a correct performance operation and steps S13 to S17 are performed. If the time difference is less than the threshold, the current key depression is considered as an erroneous operation and the process will terminates. As mentioned above, there is no previous performance timing for the first note-on message input after allocation of musical parts, therefore it is assumed at this decision step that the current key depression is a correct performance operation and steps S13 to S17 are performed.

Then, the control section 12 calculates the moving averages of time differences between note-on message inputs (step S13). As described earlier, weighted moving averages may be calculated by assigning the heaviest weight to the latest performance operation and increasingly lighter weights to older performance operations. Then, tempo and timing for a predetermined time length (for example, 1 beat) are determined on the basis of the calculated moving averages (step S14). Musical piece data is read for the predetermined time length with the determined timing and tempo and sound generation instruction data is determined, including the length of musical tone to be generated, sound volume, timbre, effect, pitch changes, and tempo (step S15). The determined sound generation instruction data is sent to the performance terminals 2 (step S16). In the case of a note-on message for the operation for determining tempo described above, determination of sound generation instruction data is omitted (or data for generating a rhythm sound is determined). In this case, the process of step S14 for determining tempo is not performed, of course.

Finally, the threshold is updated on the basis of the calculated moving average (step S17). The threshold may be updated with a half the time equal to the moving average as described above. For the first note-on message input after allocation of musical parts, there is no moving average calculated and therefore the threshold is not updated. Alternatively, the threshold may be updated to a predetermined value. If the threshold is fixed for performance of a music piece, the threshold is not updated. An initial threshold value may be preset on the basis of tempo data contained in musical piece data. Alternatively, a facilitator may manually set an initial threshold value. In this case, it may be assumed that there was a virtual previous key depression a predetermined amount of time (fore example an amount of time equal to twice a threshold) before the detection of the first key depression. This allows an erroneous key depression to be detected even it is the first key depression. Thus, players can enjoy playing without concern for erroneous performance operation from the beginning.

Since a threshold is set for the time difference between inputs of note-on messages and, if the time difference between inputs of note-on messages is less than the threshold (NO in step S12), steps S13 to S17 are skipped (ignored) as described above, erroneous performance operations will not disturb tempo and therefore even an inexperienced player can enjoy playing at ease.

Figure 6A:
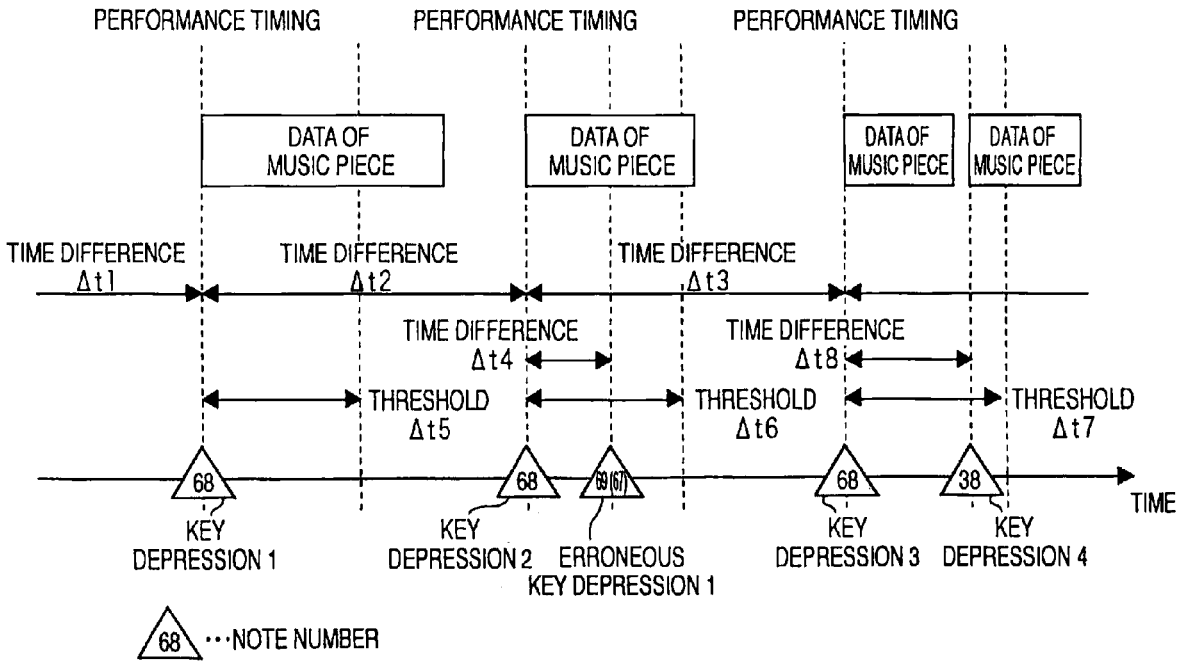
FIGS. 6A and 6B are diagrams showing the relationship between data of a music piece, a player's key depression velocity, and a specified sound volume value in variations of the example shown in FIG. 4.
Figure 6B:
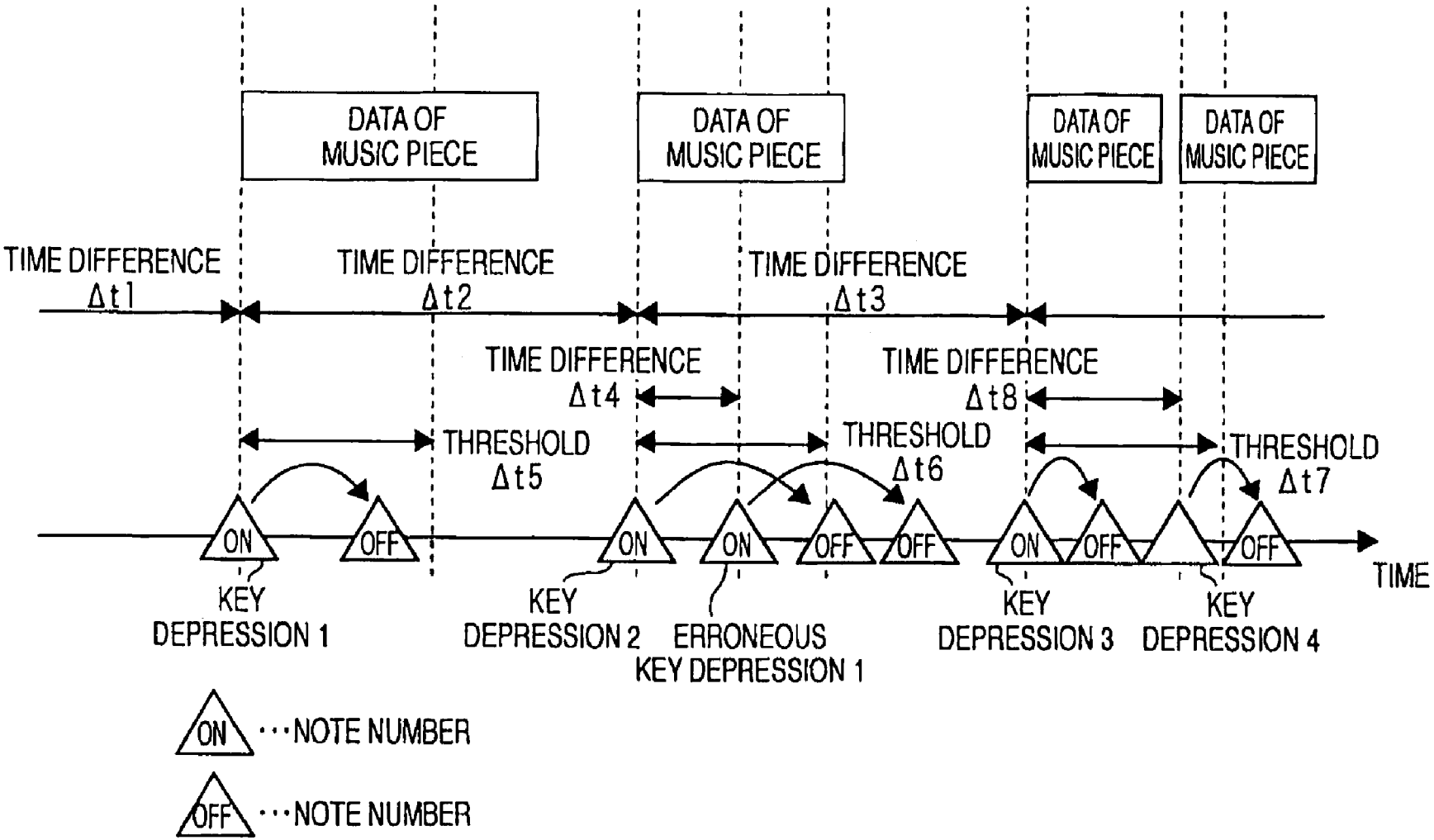

The following variations of the present embodiment are possible. FIGS. 6A and 6B are diagrams showing variations of the relationship among musical piece data, player's key depressions, and the time difference between receptions of note-on messages shown in FIG. 4. FIG. 6A shows a diagram illustrating an example in which information indicating a pitch (note number) sent from a performance terminal 2 is used to detect an erroneous operation. The same elements as those shown in FIG. 4 will be labeled the same reference symbols (Δt1-Δt7) and the description of which will be omitted.

When a player depresses a key of the keyboard 23 of a performance terminal 2, a note-on message is sent to the controller 1. The note-on message includes information indicating a note number. For example, note-on messages of key depressions 1 and 2 include information indicating note number 68.

A controlling section 12 receives the note-on message and calculates the time difference Δt2 between the reception of the previous note-on message (the timing of key depression 1) and the reception of the current note-on message (the timing of key depression 2). The time difference Δt2 is compared with a predetermined threshold Δt5. If the time difference Δt2 is greater than or equal to the threshold Δt5, the current key depression is considered as a correct performance operation and timing and tempo are determined.

Then musical piece data for 1 beat is read with the determined timing and tempo and sound generation instruction data is determined. The determined sound generation instruction data is sent to the performance terminal 2. The control section 12 updates the threshold on the basis of the time difference Δt2. The updated threshold Δt6 will be used when the next note-on message is input.

When a note-on message caused by an erroneous key depression 1 is input (an accidental key depression made when key depression 2 was performed), the time difference Δt4 between reception of the previous note-on message (the timing of key depression 2) and the reception of the current note-on message (the timing of erroneous key depression 1) is calculated as in the example described above. The time difference Δt4 is compared with the threshold Δt6. If the time difference Δt4 is less than the threshold Δt6, the note number included in the current note-on message (of erroneous key depression 1) is compared with the note number included in the previous note-on message (of key depression 2). If the note number included in the current note-on message (of the erroneous key depression 1) is a consecutive note number, 69, (or 67) immediately succeeding or the preceding note number, 68, of the previous key depression 2, the current key depression is considered as an erroneous operation and the current note-on message is ignored.

When a note-on message caused by the next key depression 3 is input, the time difference Δt3 between key depressions 2 and 3 is calculated and is compared with the threshold Δt6. If the time difference Δt3 is greater than or equal to the threshold Δt6, it is determined that this key depression is a correct performance operation and timing and tempo are determined. As a result, sound generation instruction data is determined based on key depression 3. Also, the threshold is updated based on the time difference Δt3. The updated threshold Δt7 to be used when the next note-on message is input is Δt7=Δt3/2.

When subsequently a note-on message caused by key depression 4 is input, the time difference Δt8 between key depression 3 and key depression 4 is calculated and is compared with the threshold Δt7. If the time difference Δt8 is less than the threshold Δt7, the note number contained in the current note-on message (of key depression 4) is compared with the note number contained in the previous note-on message (of key depression 3). If the note number (38 in FIG. 6A) contained in the current note-on message (of key depression 4) is not a consecutive note number before or after the note number 68 of the previous key depression 3, the current key depression is considered as a correct performance operation and timing and tempo are determined. As a result, sound generation instruction data is determined based on key depression 4.

In this way, an erroneous operation may be detected on the basis of whether note numbers are consecutive numbers, in addition to the time difference between inputs of note-on messages. If a key is mistakenly depressed by an erroneous operation, the key is likely to be a key adjacent to an intended key. Therefore, determination as to whether an operation is an erroneous operation can be restricted to keys adjacent to the previous key depressed. This can ensure an accurate determination as to whether a key depression is an erroneous one.

FIG. 6B is a diagram illustrating an example in which a note-off message sent from a performance terminal 2 is used to detect an erroneous operation. The same elements as those shown in FIG. 6A will be labeled the same reference symbols (Δt1-Δt8) and the description of which will be omitted.

When a player depresses a key of the keyboard 23 of a performance terminal 2, a note-on message is sent to the controller 1; when the player releases the depressed key, a note-off message is sent to the controller 1.

A control section 12 receives the note-on message and calculates the time difference Δt2 between the reception of the previous note-on message (the timing of key depression 1) and the reception of the current note-on message (the timing of key depression 2). The time difference Δt2 is compared with a predetermined threshold Δt5. If the time difference Δt2 is greater than or equal to the predetermined threshold Δt5, the current key depression is considered as a correct performance operation and timing and tempo are determined.

Then musical piece data for 1 beat is read with the determined timing and tempo and sound generation instruction data is determined. The determined sound generation instruction data is sent to the performance terminal 2. The control section 12 updates the threshold on the basis of the time difference Δt2. The updated threshold Δt6 will be used when the next note-on message is input.

When subsequently a note-on message caused by an erroneous key depression 1 (an accidental key depression made when key depression 2 was performed) is input, the time difference Δt4 between the reception of the previous note-on message (the timing of key depression 2) and the reception of the current note-on message (the timing of erroneous key depression 1) is calculated as mentioned above. The time difference Δt4 is compared with the threshold Δt6. If the time difference Δt4 is less than the threshold Δt6, determination is made as to whether a note-off message of the previous key depression 2 has been received. If the note-off message of the previous key depression 2 has not been received, the current key depression is considered as an erroneous operation and the current note-on message is ignored.

When a note-on message caused by the next key depression 3 is input, the time difference Δt3 between key depression 2 and key depression 3 is calculated and is compared with the threshold Δt6. If the time difference Δt3 is greater than or equal to the threshold Δt6, this key depression is considered as a correct performance operation and timing and tempo are determined. As a result, sound generation instruction data is determined based on key depression 3. The threshold is updated on the basis of the time difference Δt3. The updated threshold to be used when the next note-on message is input is Δt7=Δt3/2.

When a note-on message caused by the next key depression 4 is input, the time difference Δt8 between key depression 3 and key depression 4 is calculated and is compared with the threshold Δt7. If the time difference Δt8 is less than the threshold Δt7, determination is made as to whether a note-off message of the previous key depression 3 has been received. If the note-off message of the previous key depression 3 has been received, the current key depression is considered as a correct performance operation and timing and tempo are determined. As a result, sound generation instruction data is determined based on key depression 4.

In this way, an erroneous operation may be detected on the basis of whether a note-off message caused by the previous key depression has been input. A key adjacent to an intended key is likely to be depressed at approximately the same time as the intended key is depressed. Therefore, determination as to whether or not a key depression is an erroneous operation may be restricted to a case where a note-off message of the previous key depression has not been received. This can ensure more accurate determination as to whether a key depression is an erroneous key depression.

Determination as to whether or not a key depression is an erroneous operation may be made on the basis of a logic of key depression and release (namely a sequence of a depression and release of a key) in addition to the time difference between operations, the difference between note numbers, and whether a note-off message has been received. For example, if a key is depressed and then multiple keys are depressed before the key is released, it may be determined that the depressions of the multiple keys are erroneous depressions.

Furthermore, information indicating the intensity of a key depression (velocity) contained in an operation signal sent from a performance terminal 2 may be used to detect an erroneous operation. If the time difference between note-on message inputs is less than a threshold, the velocity of the previous key depression may be compared with the velocity of the current key depression and, if the velocity of the current key depression is approximately equal to the velocity of the previous key depression (if the difference between the velocity values is within a predetermined range), it may be determined that the current key depression is an erroneous operation.

The control section 12 of the controller 1 may count the number of erroneous key depressions performed on each of the performance terminals 2 and may records the count as a log on a HDD 13 after one music piece has been played. A facilitator can check the log to see the level of proficiency in each player. The control section 12 may determine a threshold on the basis of the number of erroneous key depressions recorded on the log. The control section 12 may set a greater threshold for a performance terminal 2 on which many erroneous key depressions have been made (such as a performance terminal 2 played by a beginner), thereby preventing erroneous operations from changing tempo and disturbing performance. On the other hand, the control section 12 may set a less threshold for a performance terminal 2 on which fewer erroneous key depression have been made (such as a performance terminal 2 played by a skilled player) to allow the player to play music with drastically varying tempo.

The ensemble system according to the present embodiment can also provide the following rendering by taking into account the gate time between a note-on and a note-off in determining tempo. For example, when a particular key is pressed and released quickly, the control section 12 (sequencing section 51) of the controller 1 may provide a short tone for the beat whereas when a key is pressed and released slowly, the control section 12 may provide a tone with a long tone for the beat. In this way, a musical rendering in which sounds are disconnected crisply (staccato) without significantly changing tempo can be implemented on a performance terminal 2 or a musical rendering in which a tone is sustained for a long time without significantly changing tempo (tenute).

Some keys of a keyboard 23 may be enabled to play staccato or tenute and the others not. The controller 1 may change the length of sounds while maintaining a constant tempo only when a note-on message or a note-off message is input from a particular key (for example, E3).

It is to be understood that the object of the present invention may also be accomplished by supplying a computer, for example, the controller 1 with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, DVD-ROM, a DVD-RAM, a DVD−RW, a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. A performance control apparatus comprising:

a performance operator adapted to generate performance operation information in response to performance operations by a user, said performance operation information including information indicative of performing timing in automatic performance;

a storage device adapted to store data of a music piece comprising sequence data of note information for individual musical tones; and a performance control device adapted to, each time said performance operation information is generated, calculate tempo of automatic performance on the basis of the difference in generation time between the present performance operation information and the previous performance operation information, and to read out said data of the music piece from said storage device with said tempo;

wherein said performance control device is adapted to exclude currently the present performance operation information from calculation of said tempo if said difference in generation time is less than a predetermined threshold and the velocity of the present performance operation information is approximately equal to the velocity of the previous performance operation information.

2. A performance control apparatus according to claim 1, wherein said performance control device is adapted to update said threshold on the basis of said difference in generation time.

3. A performance control apparatus according to claim 1, wherein said performance control device is adapted to count the present performance operation information as performance operation information generated by an erroneous operation if the difference in generation time is less than the threshold and to record information including the number of pieces of performance operation information generated by erroneous operations in said storage device.

4. A performance control apparatus according to claim 1, wherein said performance operator has a plurality of keys adapted to generate performance operation information in response to performance operations by a user, said performance operation information having different note numbers for different keys, and said performance control device is adapted to exclude the present performance operation information from calculation of said tempo if said difference in generation time is less than a predetermined threshold and the key corresponding to the present performance operation information and the key corresponding to the previous performance operation information are adjacent to each other.

5. A musical performance control apparatus according to claim 1, wherein said performance operator is adapted to, in every performance operation by a user, generate a note-on message for the performance operation information at the start of the performance operation and generate a note-off message for the performance operation information at the end of the performance operation, and said musical performance control device is adapted to exclude the present performance operation information from calculation of said tempo if the difference in generation time is less than a predetermined threshold and no note-off message is generated for the previous performance operation information.

6. A performance control apparatus comprising:

a performance operator adapted to generate performance operation information in response to performance operations by a user, said performance operation information including information indicative of performing timing in automatic performance;

a storage device adapted to store data of a music piece comprising sequence data of note information for individual musical tones; and a performance control device adapted to, each time said performance operation information is generated, calculate tempo of automatic performance on the basis of the difference in generation time between the present performance operation information and the previous performance operation information, and to read out said data of the music piece from said storage device with said tempo;

wherein said performance control device is adapted to exclude currently the present performance operation information from calculation of said tempo if said difference in generation time is less than a predetermined threshold;

wherein said performance control device is adapted to count the present performance operation information as performance operation information generated by an erroneous operation if the difference in generation time is less than the threshold and to record information including the number of pieces of performance operation information generated by erroneous operations in said storage device; and wherein said performance control device is adapted to determine the threshold on the basis of information including the number of pieces of performance operation information generated by erroneous operations recorded in said storage device.

7. A program embodied as computer executable instructions on a computer readable medium for causing a musical performance control apparatus, comprising a performance operator adapted to generate performance operation information in response to performance operations by a user, said performance operation information including information indicative of performing timing in automatic performance, and a storage device adapted to store data of a music piece comprising sequence data of note information for individual musical tones, to execute:

a performance control module of, each time said performance operation information is generated, calculate tempo of automatic performance on the basis of the difference in generation time between the present performance operation information and the previous performance operation information, and reading out said data of the music piece data from said storage device with said tempo;

wherein said performance control module comprising excluding the present performance operation information from calculation of said tempo if the difference in generation time is less than a predetermined threshold and the velocity of the present performance operation information is approximately equal to the velocity of the previous performance operation information.

8. A program embodied as computer executable instructions on a computer readable medium for causing a musical performance control apparatus, comprising, a performance operator adapted to generate performance operation information in response to performance operations by a user, said performance operation information including information indicative of performing timing in automatic performance, and a storage device adapted to store data of a music piece comprising sequence data of note information for individual musical tones, to execute:

a performance control device to, each time said performance operation information is generated, calculate tempo of automatic performance on the basis of the difference in generation time between the present performance operation information and the previous performance operation information, and to read out said data of the music piece from said storage device with said tempo;

wherein said performance control device excludes currently the present performance operation information from calculation of said tempo if said difference in generation time is less than a predetermined threshold;

wherein said performance control device counts the present performance operation information as performance operation information generated by an erroneous operation if the difference in generation time is less than the threshold and to record information including the number of pieces of performance operation information generated by erroneous operations in said storage device; and wherein said performance control device determines the threshold on the basis of information including the number of pieces of performance operation information generated by erroneous operations recorded in said storage device.

* * * * *